United States Patent [19]

Schultz

[11] Patent Number: 5,001,897

[45] Date of Patent: Mar. 26, 1991

[54] AUGMENTOR SPRAY RING MOUNT

[75] Inventor: Conrad R. Schultz, Port St. Lucie, Fla.

[73] Assignee: United Technologies Corporation, Hartford, Conn.

[21] Appl. No.: 453,885

[22] Filed: Dec. 20, 1989

[51] Int. Cl.[5] ..... F02K 3/10

[52] U.S. Cl. ..... 60/261; 60/39.31; 60/39.32

[58] Field of Search ..... 60/261, 39.32, 734, 60/739, 39.31

[56] References Cited

U.S. PATENT DOCUMENTS 3,027,715 4/1962 Morris ..... 60/39.32
3,269,116 8/1966 Frasca et al. ..... 60/261
3,768,251 10/1973 Camboulives et al. ..... 60/39.32
3,910,038 10/1975 Bourdereau et al. ..... 60/261
4,724,671 2/1988 Lapergue et al. ..... 60/261

*Primary Examiner*—Louis J. Casaregola
*Assistant Examiner*—Laleh Jalali
*Attorney, Agent, or Firm*—Edward L. Kochey, Jr.

[57] ABSTRACT

Support bracket (20) is secured to the augmentor housing (10). Spray ring adapter plate (18) is welded to the spray ring (14). Slider assembly (22) is formed of supporting part (32) bolted to the support bracket, and supported part (34) bolted to the adaptor. These parts slide with bushing (42) moveable in slot (40). Washer (46) is closely spaced from bosses (56) and (58) to take wear. Various bosses are located to preclude improper assembly, and boss (58) cooperates with end (26) of the support bracket to insure proper alignment with only a single bolt.

10 Claims, 2 Drawing Sheets

12
16
22
14
20
18
10

AUGMENTOR SPRAY RING MOUNT

The Government has rights in this invention pursuant to a contract awarded by the Department of the Air Force.

TECHNICAL FIELD

The invention relates to augmentors of jet engines and in particular to the support of fuel spray rings therein.

BACKGROUND

Jet engines of high performance aircraft often use afterburners, also known as augmentors. Increased performance is achieved at the expense of efficiency by injecting fuel and burning it between the gas turbine and the exhaust nozzle. For this injection of fuel, spray rings are often used which are comprised of annular rings located within the gas flow path having a supply line, and arranged to discharge the fuel into the gas stream.

These spray rings are exposed to the gas temperature and accordingly expand and contract therewith. They further are cooled to some extent during operation by the fuel passing therethrough. Accordingly these rings must be supported in the high velocity gas stream in a manner which permits expansion and contraction with respect to the augmentor housing.

A flexible fuel feed line is used to permit the appropriate expansion The spray ring, however, must be supported at several other locations. Flexible supports would permit continued vibration and fatigue failure of the arrangement. Since operation of flexible supports must be in an acceptable strain range, there would also be possible creep deformation.

The current spray rings use either a post and bushing mount or a mount lug bolted to a slotted bracket. These allow for radial movement of the spray ring. These mounts wear excessively in a short period of time and require a costly repair to the spray ring. The worn post and mount lugs are cut out of the spray ring and the new parts are welded in place. It is also important that the ring be supported in the prescribed location to avoid strains induced by improper mounting. Accordingly, it is important that an error proof mounting scheme be used.

SUMMARY OF THE INVENTION

The support bracket is rigidly secured to the augmentor housing and extends inwardly. It has a bracket bolt hole near the end. A spray ring adapter of plate form is welded to the spray ring and that has an adapter bolt hole near the end.

A two-part slider assembly is comprised of a supporting part and a supported part. The supporting part has a planar portion which is bolted to the support bracket and it also has an elongated slot in the direction of expansion movement of the spray ring.

The supported part is comprised of a bushing passing through the slot with the shoulder on one side of the bushing and a permanently affixed washer on the other end of the bushing A pair of bosses on the planar support engage the edges of this washer which is rectangular in form. The clearances are such that all wear occurs between the washer and the bosses with excess clearance being provided between the bushing and the edges of the slot. This supported part is bolted to the spray ring adapter.

A single bolt mounting is provided which properly aligns the slider piece. A boss is located to block rotation of a T-head bolt to facilitate assembly. The end of the support bracket is in closely spaced relationship with one of the bosses on the planar member which provides accurate alignment of the slider assembly.

The bosses are further located and extended at positions such as to preclude improper assembly.

DESCRIPTION OF THE PREFERRED EMBODIMENT

Figure 1:
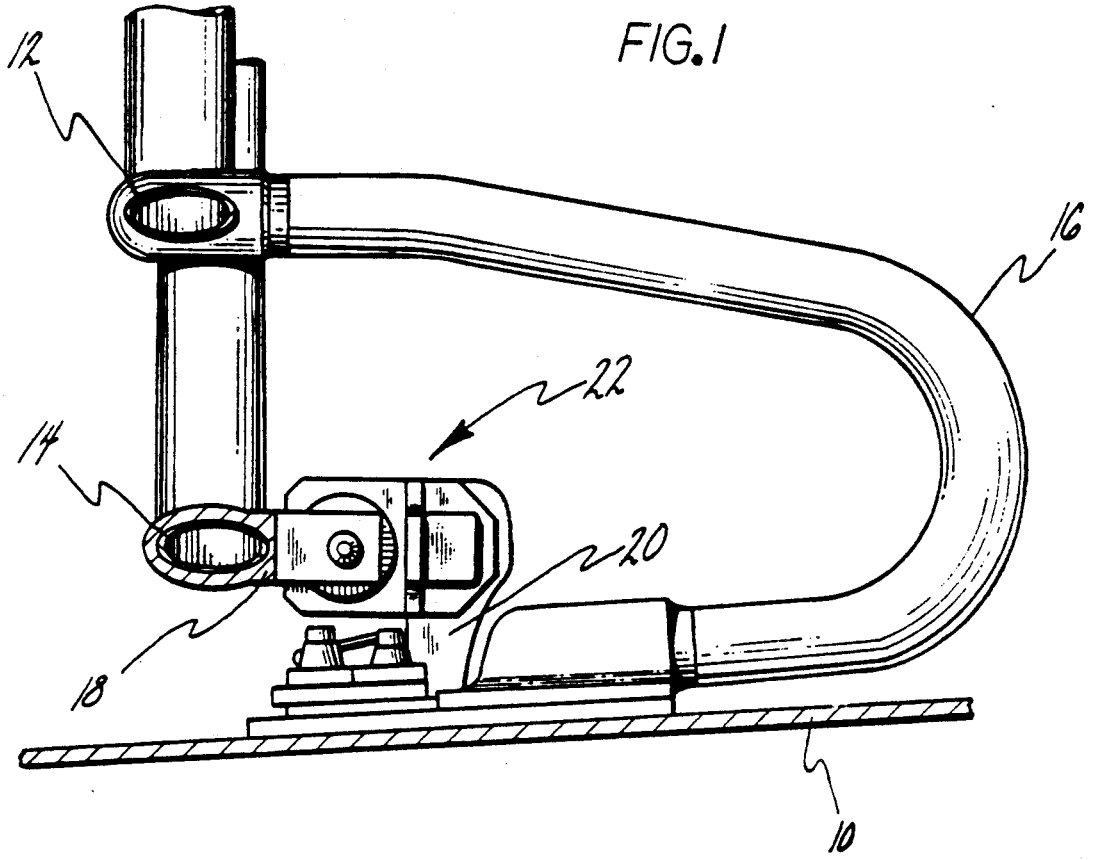
FIG. 1 shows the location of the mount arrangement.
Figure 5:
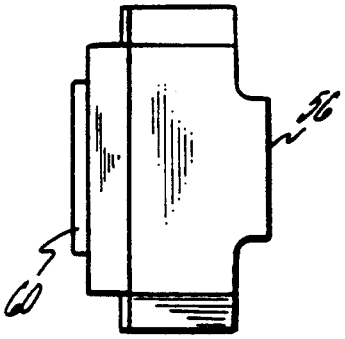
FIG. 5 is an end view of FIG. 4.
Figure 4:
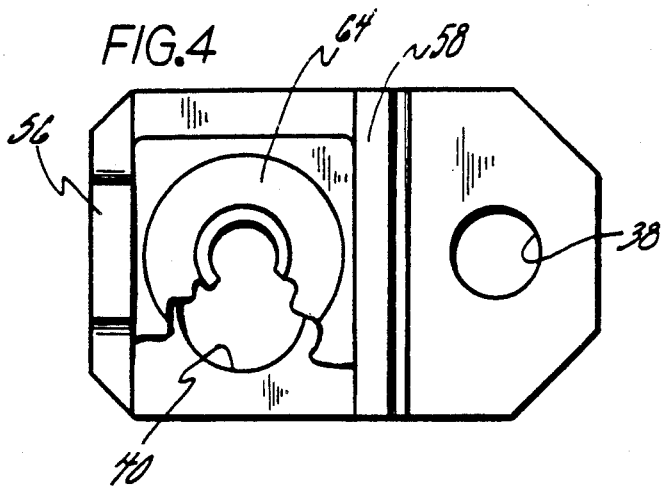
FIG. 4 is a top view of FIG. 2 with the nuts and bolts omitted.
Figure 2:
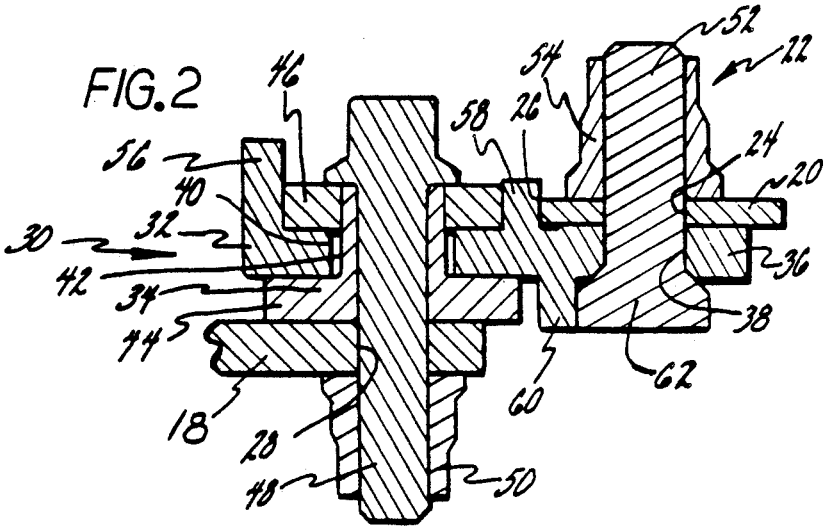
FIG. 2 is a sectional view through the mount.
Figure 3:
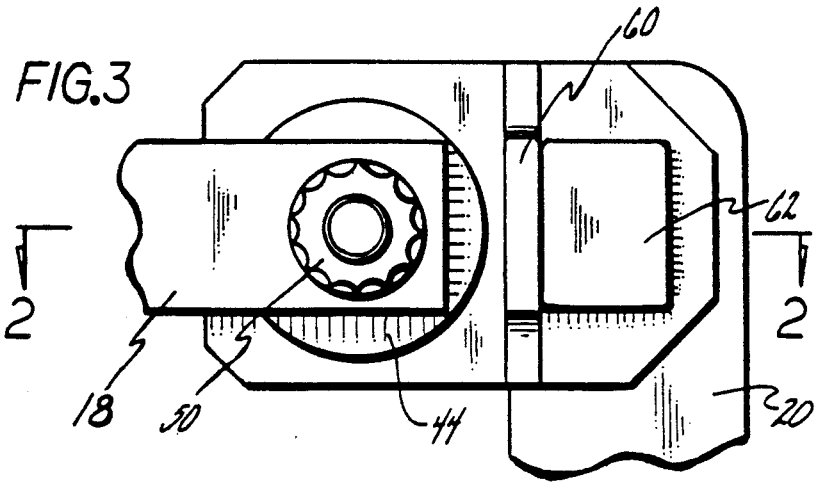
FIG. 3 is a bottom view of FIG. 2.

Referring to FIG. 1 there is shown within augmentor housing 10 an augmentor spray ring 12 and an augmentor spray ring 14. Flexible fuel line 16 is arranged to convey fuel into spray ring 12. The spray ring is conventionally formed of an oval cross section and has openings therein to introduce fuel into the flow of gasses. This spray ring 12 must be supported at other locations from housing 10.

Spray ring 14 receives its fuel from a similar feed line located elsewhere. Welded to spray ring 14 is adapter 18. Support bracket 20 is bolted to housing 10. The slider assembly 22 slideably supports the adapter 18 with respect to the bracket 20 as better seen in FIGS. 2–5.

Bracket bolt hole 24 is located near the end 26 of support bracket 20. Similarly the adapter 18 has adapter bolt hole 28 located near the end.

A two-part slider assembly 30 is comprised of a supporting part 32 and a supported part 34. The supporting part 32 has a planar portion 36 with a supporting bolt hole 38 therethrough. The planar portion also includes an elongated slot 40 which is elongated in the direction of allowable travel during expansion and contraction of the spray ring.

The supported part 34 is comprised of a bushing 42 which passes through slot 40 with a shoulder 44 on one side of the planar portion. On the other side of the planar portion a rectangular washer 46 is welded to the bushing with a slightly loose fit permitting free movement of the supported part within the supporting part. The axial clearances should be sufficient to permit this free movement but not so great so as to permit cocking and binding of the part as nut 50 and bolt 48 are tightened.

The supported portion 34 is bolted to adapter 18 with bolt 48 and nut 50. The planar portion 36 of the supported portion 32 is bolted to bracket 20 with bolt 52 and nut 54.

A first boss 56 is located on a first side of the planar portion adjacent and parallel to slot 40. On the other side of the slot a second boss 58 is also parallel to the slot. The clearance between rectangular washer 46 and bosses 56 and 58 is less than the clearance between bushing 42 and slot 40. Accordingly, all wear occurs between the rectangular washer and the bosses.

Bracket bolt hole 24 and the end 26 of the support bracket are closely toleranced with respect to the distance between supporting bolt hole 38 and boss 58. This close spacing between end 26 and boss 58 provides appropriate alignment of the slider assembly with respect to the support bracket despite the use of a single securing bolt.

There further is provided a third boss 60 adjacent to supporting bolt hole 38 which is closely spaced from the T-head 62 of bolt 52. This facilitates installation of the single bolt which together with surface 26 provides proper alignment.

First boss 56 is longer than the width of washer 46 thereby precluding inadvertent attachment of bracket 20 to the wrong side of the slider assembly. The boss 56 would interfere and it would be obvious that the mount was being improperly assembled.

It is also noted that third boss 60 is closer to the bolt hole than second boss 58. This makes it impossible to assemble the slider on the wrong side of support bracket 20. The spot face 64 is provided on the upper surface of rectangular washer 46 for the purpose of smoothing the weld area between the washer and the bushing 42.

Accordingly, an augmentor mount is provided which has sliding movement providing damping action and wherein the wear is taken between the rectangular washer and the bosses of the slider plate. Replacement of the slider assembly is simply achieved by simple unbolting the old part and bolting in the new part with no need to rework the spray ring or the support bracket. Appropriate alignment is achieved with single bolts for each connection and error proof installation is provided.

I claim:

1. An augmentor spray ring mount for guiding and supporting a spray ring within an augmentor housing comprising:

a support bracket rigidly secured to said augmentor housing and extending inwardly, and having a bracket bolt hole therein;

a spray ring adapter of plate form welded to said spray ring and having an adapter bolt hole therein;

a two-part slider assembly comprised of a supporting part and supported part;

said supporting part having a planar portion with a supporting bolt hole therein, bolted to said support bracket and having an elongated slot therethrough; and said supported part comprised of a bushing passing through said slot, a shoulder on one end of said bushing and a permanently affixed washer on the other end of said bushing for slideably entrapping said bushing within said slot of said supported part, said bushing being bolted to said adapter.

2. A mount as in claim 1:

said planar portion having a first boss on a first side of said planar portion adjacent and parallel to said elongated slot, and a second boss on said first side parallel to said first elongated slot on the other side of said slot;

said washer being rectangular; and the clearance between said washer and said first and second bosses being less than the clearance between said bushing and the sides of said slot.

3. A mount as in claim 2:

said first boss extending from the surface of said planar portion a distance greater than the thickness of said washer.

4. A mount as in claim 2:

said second boss also located adjacent to said supporting bolt hole, said support bracket having an end adjacent to said bracket bolt hole located to be in closely spaced relationship with said second boss when said supporting bolt hole and said bracket bolt hole are aligned; and a single bracket bolt securing said supporting part to said bracket.

5. A mount as in claim 4:

said bracket bolt being a T-head bolt;

a third boss on the second side of planar portion located adjacent to said supporting bolt hole sufficiently close to prevent rotation of said T-head bolt by interference with the T-head of said T-head bolt.

6. A mount as in claim 5:

said third boss being closer to said supporting bolt hole than said second boss, whereby said planar portion cannot be installed in an inverted position.

7. A mount as in claim 6:

said first boss extending from the surface of said planar portion a distance greater than the thickness of said washer.

8. A mount as in claim 1:

first boss adjacent said washer and extending from the surface of said planar portion a distance greater than the thickness of said washer.

a second boss located adjacent to said supporting bolt hole, said support bracket having an end adjacent to said bracket bolt hole located to be in closely spaced relationship with said second boss when said supporting bolt hole and said bracket bolt hole are aligned; and a single bracket bolt securing said supporting part to said bracket.

9. A mount as in claim 8:

said bracket bolt being a T-head bolt;

a third boss on the second side of planar portion located adjacent to said supporting bolt hole sufficiently close to prevent rotation of said T-head bolt by interference with the T-head of said T-head bolt.

10. A mount as in claim 9:

said third boss being closer to said supporting bolt hole than said second boss, whereby said planar portion cannot be installed in an inverted position.

* * * * *